US005596819A

United States Patent [19]

Goldston et al.

[11] Patent Number: 5,596,819

[45] Date of Patent: Jan. 28, 1997

[54] REPLACEABLE SHOE HEEL SPRING AND STABILIZER

[75] Inventors: Mark R. Goldston, Santa Monica; Jon Bemis, Rancho Palos Verdes; David Pelsue, Downey, all of Calif.

[73] Assignee: L.A. Gear, Inc., Santa Monica, Calif.

[21] Appl. No.: 469,793

[22] Filed: Jun. 6, 1995

Related U.S. Application Data

[63] Continuation of Ser. No. 13,633, Feb. 4, 1993, abandoned.

[51] Int. Cl.[6] ..... A43B 21/26; A43B 13/28; A43B 21/32

[52] U.S. Cl. ..... 36/35 R; 36/27; 36/37

[58] Field of Search ..... 36/27, 114, 30 R, 36/30 A, 32 R, 37, 38, 107, 108, 28

[56] References Cited

U.S. PATENT DOCUMENTS

| | | | |
|---|---|---|---|
| 2,184,210 | 12/1939 | Burger | 36/37 |
| 2,821,793 | 11/1956 | Kornberg | 36/37 |
| 2,825,154 | 1/1957 | Windle | 36/38 |
| 2,836,907 | 8/1957 | Windle | 36/38 |
| 4,342,158 | 8/1982 | McMahon et al. | 36/35 R |
| 4,430,817 | 2/1984 | Bente | 36/32 R |
| 4,624,061 | 11/1986 | Wezel et al. | 36/30 A |
| 4,680,876 | 7/1987 | Peng | 36/37 |
| 4,756,095 | 7/1988 | Lakic | 36/27 X |
| 4,941,273 | 7/1990 | Gross | 36/114 |
| 5,152,081 | 10/1992 | Hallenbeck et al. | 36/28 |
| 5,187,883 | 2/1993 | Penney | 36/35 R |
| 5,224,277 | 7/1993 | Sang Do | 36/27 |

FOREIGN PATENT DOCUMENTS

| | | |
|---|---|---|
| 200368 | 7/1923 | United Kingdom . |
| 427126 | 4/1935 | United Kingdom . |

*Primary Examiner*—B. Dayoan
*Attorney, Agent, or Firm*—Don C. Lawrence, Esq.

[57] ABSTRACT

A replaceable shoe heel spring assembly allows the wearer of a shoe to selectively change the energy absorption and return characteristics of the heel portion of the shoe by changing shoe heel spring cartridges. The wearer activates a release mechanism located on an exterior surface of the shoe and a cartridge containing a shoe heel spring is ejected from a location in the mid-sole of the shoe. Another shoe heel spring cartridge having different energy absorption and return characteristics can then be inserted into the mid-sole. The cartridge is securely held in the mid-sole by a locking mechanism connected to the release mechanism. The shoe heel spring is provided with a cover which matches the material of the mid-sole. The cover assists in preventing debris from entering the mid-sole. The selectable range of energy absorption and return characteristics is limited only by the number of cartridges available.

26 Claims, 3 Drawing Sheets

FIG. 3
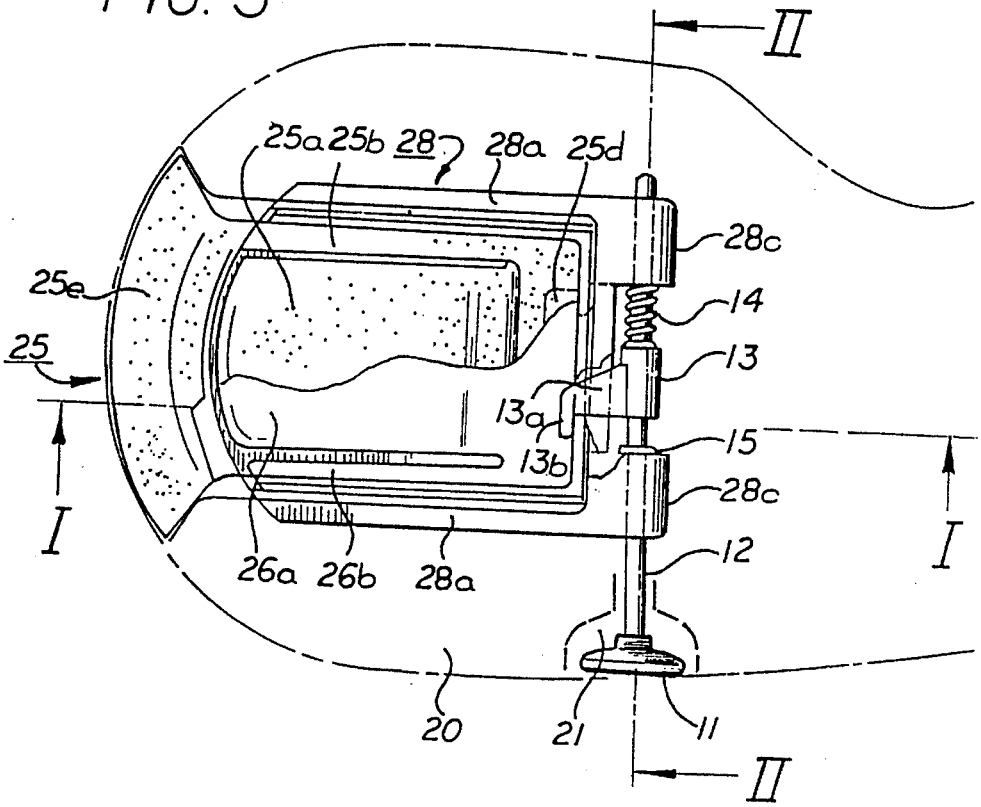
FIG. 4
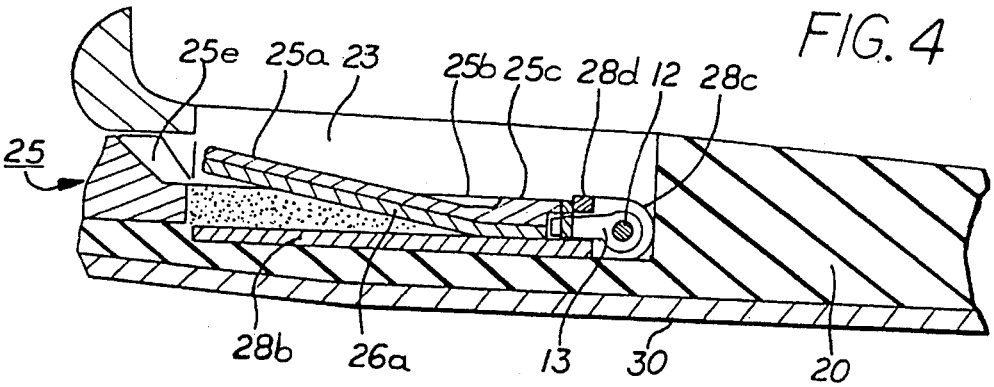
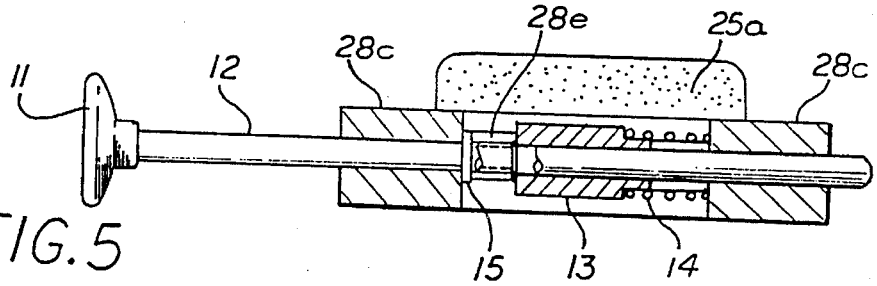
FIG. 5

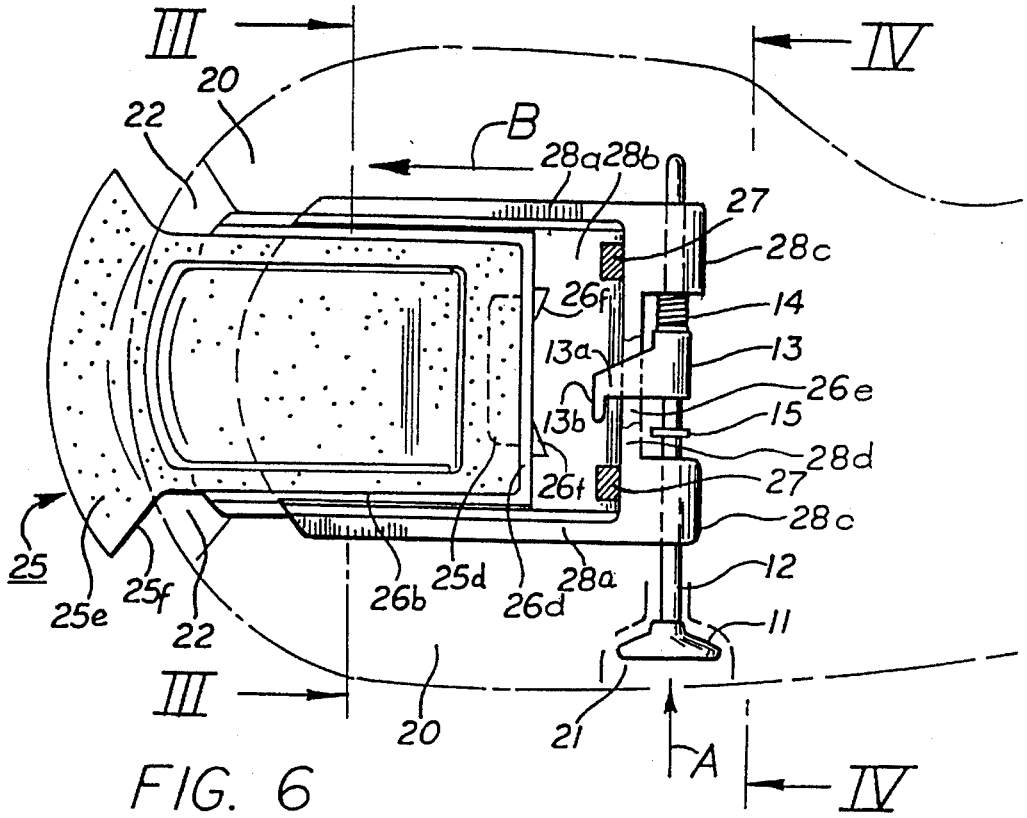
FIG. 6
FIG. 7
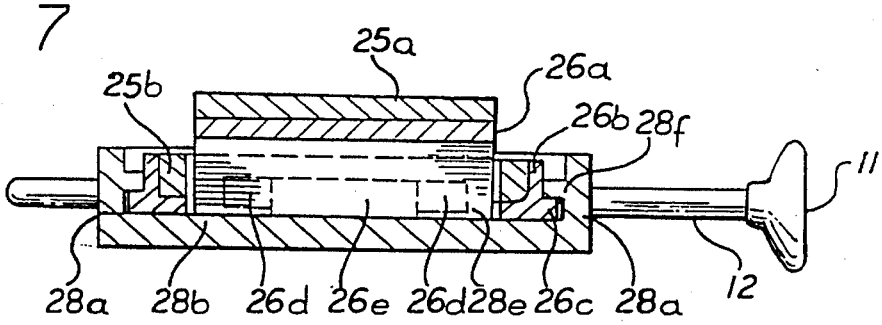
FIG. 8
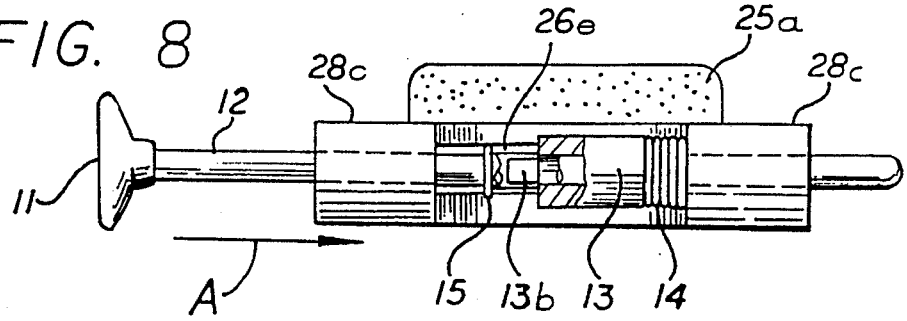

REPLACEABLE SHOE HEEL SPRING AND STABILIZER

This is a continuation of application Ser. No. 08/013,633, filed Feb. 4, 1993, now abandoned.

1. FIELD OF THE INVENTION

This invention pertains in general to footwear, and in particular, to a replaceable shoe heel spring and foot stabilizing device for an athletic shoe.

1a. RELATED APPLICATIONS

This application is also related to U.S. application Ser. No. 08/013,700, now U.S. Pat. No. 5,437,110, filed on even date herewith entitled Adjustable Shoe Heel Spring and Stabilizer, which application is also incorporated herein by reference in its entirety.

2. DESCRIPTION OF THE RELATED ART

In general, the act of walking or running involves the use of the entire foot. For most, walking or running starts with a heel strike, followed by a rolling onto the mid-foot, and then finally by a propelling-off with the forefoot and toes. Before heel strike, the foot is in a supinated position, i.e., orientated at an angle relative to the ground and twisted outward. At heel strike, the involved ankle, knee and hip all flex to cushion and absorb the shock of the impact. The foot rolls and turns inward in a process called pronation.

Especially for an athlete, during this sequence, it is desirable to absorb as much of the foot-strike shock energy as possible, consistent with landing stability to avoid chronic or traumatic injury to the athlete. Where possible, and again, consistent with good running stability, it is also desirable to store the shock energy absorbed and return it to the foot during the propelling off motion of the stride, for energy-efficiency purposes. It is also desirable to limit any tendency of the foot to over-supinate or over-pronate during contact of the foot with the ground, for both medical and running stability reasons.

Depending upon the nature of the activity that the wearer is involved in, the desired amount of energy absorption may change. For example, a long-distance runner may desire a high level of foot-strike shock energy absorption, whereas, an individual who walks for exercise may not require, or desire, as much energy absorption. In a similar fashion, depending upon a person's physical condition, they may desire more or less energy absorption. For example, an individual who has chronic ankle, knee or hip ailments, may desire a high level of energy absorption. In contrast, an individual who is recovering from an injury may initially, in the beginning stages of a rehabilitation regimen, require a high level of energy absorption. In the latter stages of the rehabilitation therapy, such an individual may want to limit the energy absorption to produce a higher stress on the injured area consistent with the rehabilitation regimen.

Thus, depending upon the nature of the activity, or the particular needs of the individual wearer, it would be desirable to have a shoe which is capable of providing a user selectable amount of foot-strike shock energy absorption, resulting in a corresponding changed amount of stored shock energy. It would also be desirable to return the stored shock energy to the foot of the wearer during the propelling-off portion of the stride. Further, it would be desirable to provide a shoe which provides for a user selectable amount of energy absorption and return characteristics, as discussed above, which is also capable of stabilizing the foot of the wearer to limit the tendency of the foot to over-supinate or to over-pronate during contact of the foot with the ground.

It is known in the shoe art to incorporate spring devices in the soles of shoes, and particularly, the heels of shoes, to store shock energy imparted by foot strike during running and to return at least a portion of that energy to the wearer's foot during foot lift. It is likewise known to provide transverse and longitudinal stiffening elements within the sole of a shoe to overcome the effect of over-supination or over-pronation of the wearer's foot during running.

For example, in U.S. Pat. Nos. 4,486,964 and 4,506,460, M. F. Rudy describes various types of plastic and heat-treated steel "spring moderators" whose primary purpose is said to be to distribute foot strike forces more evenly and quickly to underlying, gas-filled sole member. A horseshoe-shaped heel component of these moderators is said to act like a Bellville spring in cooperation with the foot to store and return energy during running, and in one version, is also said to provide stabilization of the ankle.

In U.S. Pat. Nos. 2,357,281 and 2,394,281, V. P. Williams discloses a shock resisting built-up heel assembly for dress shoes which incorporates a steel spring. The outer portion of the heel is molded of rubber with an internal cavity and a protrusion extending from the bottom of the heel. Upon heel strike, the protruding portion of the heel contacts the ground first and then collapses into the cavity formed in the heel. The steel spring serves primarily to re-extend the protruding portion of the heel upon heel lift.

In U.S. Pat. No. 4,709,489, K. Welter describes a spring device for a shoe heel which comprises a steel plate supported at its lateral ends by a U-shaped, non-compressible support member. In addition to providing a heel-spring effect, the support member is also said to provide lateral stabilization of the heel.

In U.S. Pat. No. 4,881,329, K. Crowley discloses yet another form of energy storing heel spring that is said to be manufactured from high tensile materials such as graphite and/or glass fibers and resin.

In U.S. Pat. No. 4,815,221, J. Diaz discloses an energy control system positioned in a cavity formed in the mid-sole of an athletic shoe. Diaz provides a spring plate having a plurality of spring projections protruding from, and distributed over, the surface of the plate. The plurality of spring projections absorb energy during heel strike and return the energy to the foot of the wearer during the propelling-off portion of the stride. Because of the structure of the spring members, the energy which is returned to the wearer's foot has a forward component to assist in propelling the wearer in the forward direction.

Finally, in U.S. Pat. Nos. 4,854,057, and 4,878,300, to K. Misevitch, et al. and R. Bogaty, respectively, various configurations of stability plates are shown which are made of various compositions of fiberglass and polyester resin.

3. SUMMARY OF THE INVENTION

This application is directed to a novel device which is disposed in the mid-sole of a shoe, preferably in an athletic shoe, which combines the advantages of a replaceable heel spring cartridge which absorbs, stores and returns to the wearer's foot shock energy experience during walking or running, and a stabilizer plate which, during the same activity, aids in the prevention of the over-supination and over-pronation of the foot.

The wearer of a shoe incorporating the replaceable shoe heel spring and stabilizer device of the present invention can achieve variations in the perceived hardness of the shoe sole. The number of variations is limited solely by the number of different cartridges available.

The replaceable shoe heel spring and stabilizer device of the present invention provides a simple means for the wearer of the shoe to replace one energy absorbing and returning spring assembly with another having different energy absorption and return characteristics. The device is inexpensive to manufacture and has the added advantage of being light in weight, which makes it ideally suited for use in athletic shoes.

A better understanding of the device, along with its many attendant advantages, can be had from a consideration of a detailed description of its preferred embodiments which follows hereinafter, particularly when considered in light of the accompanying drawing, of which the following is a description.

4. BRIEF DESCRIPTION OF THE DRAWING

FIG. 3 is a partial top view of the mid-sole of a shoe including the device of the present invention in the inserted and locked position;

FIG. 4 is a partial side view of the device of the present invention in the inserted and locked position taken along the line I—I of FIG. 3;

FIG. 5 is a rearward, cross-sectional view of the device of the present invention in the inserted and locked position taken along the line II—II of the FIG. 3;

FIG. 6 is a partial top view of the mid-sole of a shoe incorporating the device of the present invention as it is being removed from the mid-sole;

FIG. 7 is a forward, cross-sectional view of the device of the present invention taken along the line III—III of FIG. 6; and FIG. 8 is a rearward, cross-sectional view of the device of the present invention taken along the line IV—IV of FIG. 6.

4. DETAILED DESCRIPTION OF THE PREFERRED EMBODIMENTS

Figure 1:
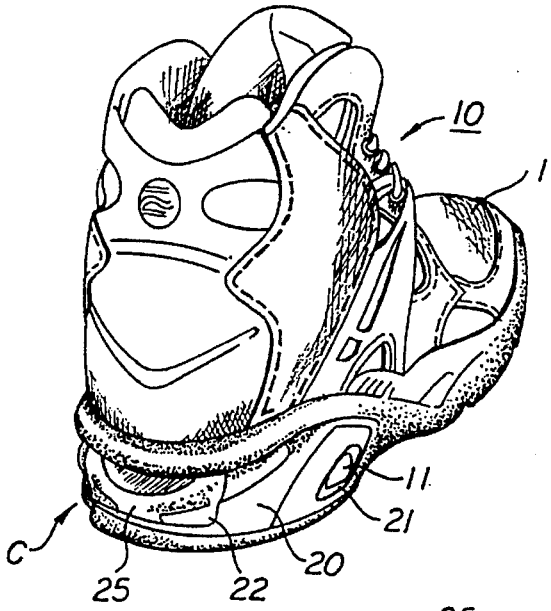
FIG. 1 is a rear perspective view of a right-foot athletic shoe within which the device of the present invention is incorporated.

FIG. 1 illustrates a typical athletic shoe 10 for the right foot of the wearer which incorporates the device of the present invention. The illustrated athletic shoe 10 includes an upper 1 connected with a mid-sole 20. The mid-sole 20 is provided with a recess 21 which accommodates a release knob or button 11. As illustrated, the recess 21 is formed on an exterior outside surface of the mid-sole 20 relative to the foot of the wearer, but could also be provided on an inside surface.

In addition to the recess 21, the mid-sole 20 is provided with an opening 22 in the rear portion of the mid-sole relative to the wearer's foot. Preferably, the opening 22 is formed at the very back of the mid-sole 20. Inserted in the opening 22 in FIG. 1 is a replaceable shoe heel spring cartridge C having a cover 25. The cover 25 is formed to match the exterior surface dimensions of the mid-sole 20 to provide an aesthetically pleasing look to the mid-sole, while also serving to prevent debris from entering the recess in mid-sole 20.

Alternatively, the cover can be molded to appear in any desired shape or color. The mid-sole 20 and cover 25 are generally formed of polyurethane or "PU". Alternatively, the mid-sole 20 and cover 25 could be formed from compression molded ethyl vinyl acetate ("EVA"), or other suitable materials.

Figure 2:
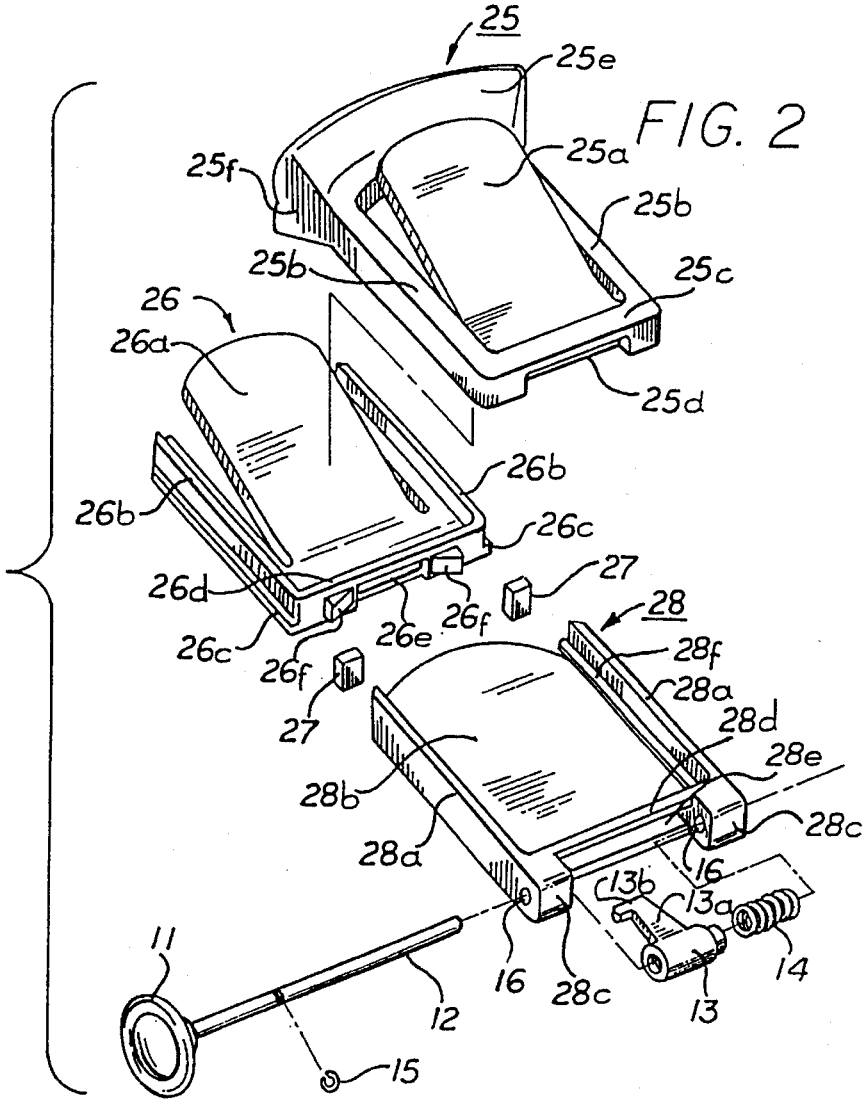
FIG. 2 shows the constituent parts of the replaceable shoe heel spring assembly and receptacle in a disassembled fashion.

As shown in FIG. 2, the cover 25 includes an upwardly inclined spring member cover 25*a*, a pair of a side rails 25*b*, a front wall portion 25*c*, a recess 25*d* formed in the front wall portion to accommodate a locking mechanism discussed below, and inclined surfaces 25*e* and 25*f* at the rear portion of the cover 25 which match the angles of the surfaces forming the opening 22 illustrated in FIG. 1. The cover 25 is molded as a single piece and is sized so as to fit snugly and securely within the opening 22 to assist in preventing debris from entering the interior of the mid-sole 20.

The cover 25 is also molded so as to provide a matching fit with a spring mechanism 26 that it covers. Together, the spring mechanism 26 and cover 25 form the replaceable shoe heel spring cartridge C that may be changed by the wearer of the shoe.

The spring mechanism 26, which may be formed from a glass or carbon filled thermoplastic, a nylon resin such as Zytel, an acetal resin such as Delrin, or other suitable thermoplastics, is generally disposed in a substantially horizontal position relative to the out-sole 30 of the athletic shoe 10.

The spring mechanism 26 includes a spring member 26*a* which is rearwardly and upwardly inclined relative to the plane of the spring mechanism 26, a pair of lateral side rails 26*b* having ledges 26*c* formed along lower lateral sides thereof, a front wall portion 26*d* which connects the lateral side rails 26*b* and which includes an opening 26*e* formed therein to accommodate the locking mechanism 13 discussed in detail below. On an exterior surface of the front wall 26*d*, are formed a pair of angled guide members 26*f* which serve to guide the locking mechanism 13 to the opening 26*e*.

Ejection springs 27, which serve to at least partially eject the cartridge C from the mid-sole 20, are disposed on an exterior surface of the front wall 26*d* of the spring mechanism 26 at positions which are slightly outboard of the guide members 26*f*. The ejection springs 27 may be formed of a spring steel, or, alternatively, may be formed of a polymeric cellular or non-cellular material that possesses high rebound characteristics. The ejection springs 27 could also be disposed on the receptacle 28 as discussed below.

The receptacle 28 comprises a pair of lateral side rails 28*a* which include a pair of guide rails 28*f*, only one of which is visible in FIG. 2, and a bottom surface portion 28*b*. The bottom surface 28*b* and rails 28*f* prevent the cartridge C from moving in the vertical direction when the cartridge C is inserted into the mid-sole 20.

A pair of shaft guides, 28*c* are formed on a front wall portion 28*d* of the receptacle, which wall also includes an opening 28*e* formed to accommodate the locking mechanism 13.

The receptacle 28 is preferably injection molded from a polycarbonate synthetic thermoplastic, or in the alternative, an acetal resin or nylon resin. Ideally, the chosen material is different from that of the spring mechanism 26. By using different materials, it is possible to avoid excessive friction (and therefore excessive wear and tear) which may occur if the receptacle 28 and the spring mechanism 26 are formed of the same materials.

In addition to serving as the receiver of the replaceable cartridge C, the receptacle also stabilizes the wearer's foot and assists in preventing over-supination and over-pronation. The lateral sides 28*a* of the receptacle 28 are positioned slightly outboard of the sides of the wearer's heel in order to act in a manner analogous to outriggers on a canoe. This, prevents the wearer from "rolling off" the spring member 26*a* and stabilizes the foot.

As mentioned above, the ejection springs 27 may be disposed on the receptacle 28. The desired location on the receptacle 28 would be on the rearward facing surface of the front wall portion 28*d* at positions directly opposite their location on the front wall 26*d*. In either position, the springs 27 bias the cartridge such that when the wearer operates the release knob or button 11, the cartridge will be partially ejected from the mid-sole 20.

The release knob or button 11, which is preferably located within a recess 21 formed in an exterior surface of the mid-sole 20, connects to, or may be molded with, a shaft 12. The release knob or button 11 is preferably a thermoplastic and the shaft 12 may be metal or thermoplastic. On the shaft 12 is disposed a catch or keeper device 13 and a spring 14 which is typically formed of a spring steel. The keeper 13 may be secured to the shaft 12 through the use of an adhesive such as cyanoacrylate. Alternatively, the keeper 13 may be secured to the shaft through the use of a screw, pin or other securing mechanism. The shaft 12 passes through holes 16 formed in the shaft guides 28*c* and is held in place utilizing a C-ring 15.

While it may be possible to form the release knob or button 11, shaft 12 and keeper 13 as a single piece from the same material such as a thermoplastic, such a structure will require an opening in at least one of the shaft guides 28*c* to enable the shaft 12 to be appropriately positioned.

The keeper 13 has an arm 13*a* extending in a radially outward fashion from the axis of the keeper 13 along a line generally parallel with the plane of the receptacle 28. A hook or catch 13*b* is disposed at the end of the arm 13*a* and engages the rearward facing surface of the front wall 26*d* of the spring mechanism 26 when it is fully inserted into the receptacle 28. The operation of the release knob or button 11 and keeper 13 will be more apparent from the discussion below.

In particular, as can be seen in FIG. 3, the release knob or button 11 is flush with the exterior surface of the mid-sole 20 in the recess 21. The cover 25 is also flush with the exterior side surface of the mid-sole 20. The keeper 13 passes through the openings 28*e* and 26*e* formed in the receptacle 28 and spring mechanism 26, respectively, and engages an interior surface of the front wall 26*d*. The spring 14 biases the keeper 13 in a direction along the shaft 12 toward the release knob or button 11, so that the hook or catch 13*b* maintains a secure hold of the spring mechanism 26. This is the normal position of the spring mechanism 26 and cover 25 when the wearer of the athletic shoe 10 has the replaceable shoe heel spring cartridge C inserted in the mid-sole 20.

As can be seen in FIG. 4, the cover 25 is molded to mate appropriately with the spring mechanism 26 such that, for example, the upwardly inclined surface 25*a* of the cover 25 matches the angle of inclination and the size of the spring member 26*b*. FIG. 4 also shows the cavity 23 which 20 is formed in the mid-sole 20. The base portion 28*b* of the receptacle 28 is adhered to the lower surface of the cavity 23 through the use of an adhesive, such as cyanoacrylate.

As illustrated, with the cartridge C inserted, the cover 25 and spring 26 are disposed in a generally horizontal position relative to the out-sole 30, with spring member 26*a* being positioned below the calcaneus, or heel bone, of the wearer's foot.

FIG. 5 shows how the C-ring 15 prevents the shaft 12 from moving laterally relative to the mid-sole 20. The spring 14 biases the keeper 13 towards the release knob or button 11. The C-ring 15 limits the lateral movement of the shaft 12 such that the release knob or button 11 is normally flush with the exterior of out-sole 20.

The C-ring 15 is necessary because, while the front wall 26*d* will limit movement of the keeper 13 when the replaceable cartridge C is inserted, when the cartridge C is removed from the mid-sole 20, the arm 13*a* will no longer engage the front wall 26*d*, necessitating the use of C-ring 15.

FIGS. 6–8 serve to illustrate the operation of the release knob or button 11 when the wearer desires to change the replaceable shoe heel spring cartridge C. The wearer simply presses the release knob or button 11 along the direction of the arrow "A", which causes the keeper 13 to be pushed in a direction matching that of arrow A, which in turn, causes the compression of the spring 14 as shown. The hook or catch 13*b* then disengages from the inner surface of the front wall 26*d*, and the ejection springs 27 cause the cartridge C to be ejected in the direction identified by the arrow "B" out from the mid-sole 20. The ejection springs 27 only need to be strong enough to push the cartridge C a distance sufficient to prevent the hook or catch 13*b* from re-engaging with the front wall 26*d* of the spring mechanism 26.

To insert a new cartridge C, the wearer simply inserts the cartridge C into the opening 22 and pushes with a slight force on the exterior surface of the cover 25. It is not necessary for the wearer to depress the release knob or button 11. Rather, one of the angled guide members 26*f* will contact the hook or catch 13*b* disposed at the end of the arm 13*a* of the keeper 13. As the applied force overcomes the force of spring 14, the hook 13*a* is guided along the angled surface to the window 26*e*. When the hook 13*b* passes through the window 26*e*, spring 14 causes the hook 13*b* to securely engage the front wall 26*d*.

FIG. 7 shows the interaction of the guide rails 26*c*, with the rails 28*f* of the receptacle 28. As can be seen, the rails 28*f* prevent any upward movement of the spring mechanism 26 when it is inserted into the receptacle 28, and the bottom surface 28*b* prevents any downward movement. In this fashion, with the hook 13*b* securing the spring mechanism 26 at the front wall 26*d*, the replaceable cartridge C is securely held in position.

FIG. 8 illustrates the release knob or button 11 and shaft 12 being depressed along the direction indicated by the arrow A. This causes the ejection of the cartridge C through the action of the ejection springs 27 when hook 13*b* clears the front wall 26*d*.

Finally, it should be noted that all of the parts, including the spring mechanism 26, the receptacle 28, the keeper 13, etc., are formed with precise tolerances in the preferred embodiment to prevent any unnecessary, undesirable movement or vibration of the cartridge C when it is inserted into the mid-sole 20. In this fashion, the wearer of the shoe 10 will experience no undesirable rattling or excessive sensations of movement within the heel of the shoe 10, and indeed the heel should feel no different than the heel in the above-referenced U.S. patent application Ser. No. 07/549,493, which has a spring mechanism permanently molded in the mid-sole.

The skilled practitioner will recognize from the foregoing discussion that many modifications are possible to the features, materials and methods of manufacture of the replaceable shoe heel spring and stabilizer device disclosed above, depending upon the particular problem or application at hand.

For example, rather than relying upon an insertion point for the cartridge C at the rear of the shoe 10, it may be possible to manufacture the device of the present invention having a side or bottom entry point for the replacement cartridges.

Further, the types of materials may be altered from the above recommended materials. For example, natural rubber has been known as a mid-sole material, and metal and other such materials may be used in the building of the shaft and spring assemblies. All such alternative materials are considered to fall within the scope of the present invention.

In this fashion, it is to be understood that the embodiments illustrated and discussed herein should be taken as exemplary in nature only, and the scope of the present invention should be limited only by the claims that follow.

We claim:

1. An athletic shoe comprising:

an upper;

a mid-sole formed from a resilient material;

an out-sole;

absorbing means, selectively replaceable by a user of the athletic shoe, for absorbing shock energy and returning at least a portion of the absorbed shock energy to the foot of the user, wherein the absorbing means comprises a replaceable spring cartridge including a spring plate having a spring member upwardly inclined and cantilevered relative to a plane of the spring plate, and a first pair of lateral side rails; and receptacle means for supporting the absorbing means in the athletic shoe.

2. An athletic shoe according to claim 1, wherein the receptacle means is disposed in the mid-sole of the athletic shoe, the mid-sole having an opening formed therein to enable the absorbing means to be inserted into and removed from the receptacle means by the user.

3. An athletic shoe according to claim 2, wherein the receptacle means includes locking means for securely engaging the absorbing means in the receptacle means.

4. An athletic shoe according to claim 3, further including release means, connected with the locking means and operable by the user, for releasing the absorbing means from locking engagement with the receptacle means.

5. An athletic shoe according to claim 4, further including ejection means for at least partially ejecting the absorbing means from the receptacle means upon operation of the release means.

6. An athletic shoe according to claim 3, wherein the receptacle means includes stabilizing means for stabilizing the foot of the user, thereby preventing over-supination and over-pronation of the user's foot.

7. An athletic shoe according to claim 1, wherein the replaceable spring cartridge includes a cover formed of the resilient material.

8. An athletic shoe according to claim 1, wherein the receptacle means includes a base plate and a second pair of lateral side rails, the second pair of lateral side rails slidably engaging the first pair of lateral side rails as the replaceable spring cartridge is inserted into and removed from the receptacle means.

9. An athletic shoe according to claim 8, wherein the base plate and second pair of lateral side rails serve to prevent vertical and lateral movement of the replaceable spring cartridge when the replaceable spring cartridge is inserted in the receptacle means.

10. An athletic shoe according to claim 9, wherein the receptacle means includes locking means, responsive to a predetermined force from the user, for locking the replaceable spring cartridge in an inserted position in receptacle.

11. An athletic shoe according to claim 10, further including releasing means, disposed on a surface of the athletic shoe and operable by the user, for releasing the replaceable spring cartridge from the locking means.

12. An athletic shoe according to claim 11, further including ejection means, disposed on at least one of the replaceable spring cartridge and the receptacle means, for ejecting the replaceable spring cartridge from the receptacle means upon operation of the release means by the user.

13. A shoe comprising:

an upper;

a sole formed from a resilient material;

absorbing means, selectively replaceable by a wearer of the shoe, for absorbing shock energy and returning at least a portion of the absorbed shock energy to the foot of the wearer, the absorbing means comprising a removable spring cartridge including a spring plate having a spring member upwardly inclined and cantilevered relative to a plane of the spring plate, and a first pair of lateral side rails; and receptacle means for supporting the absorbing means in the shoe.

14. A shoe according to claim 13, wherein the receptacle means is disposed in the sole of the shoe, the sole having an opening formed therein to enable the absorbing means to be inserted into and removed from the receptacle.

15. A shoe according to claim 14, wherein the receptacle means includes means for securing the absorbing means to the receptacle means.

16. A shoe according to claim 15, further including release means, operable by the wearer, for releasing the absorbing means from the receptacle means.

17. A shoe according to claim 16, further including ejection means for at least partially ejecting the absorbing means from the receptacle means upon operation of the release means by the wearer.

18. A shoe according to claim 13, wherein the receptacle means includes stabilizing means for stabilizing the foot of the wearer, thereby preventing over-supination and over-pronation of the wearer's foot.

19. A shoe according to claim 13, wherein the sole includes an opening formed therein to enable the absorbing means to be inserted into and removed from the receptacle means.

20. A shoe according to claim 19, wherein the removable spring cartridge includes a cover formed of the resilient material.

21. A shoe according to claim 19, wherein the receptacle means includes a base plate and a second pair of lateral side rails, the second pair of lateral side rails slidably engaging the first pair of lateral side rails as the removable spring cartridge is inserted into and removed from the receptacle means.

22. A shoe according to claim 21, wherein the base plate and second pair of lateral side rails are formed so as to prevent vertical and lateral movement of the removable spring cartridge when it has been inserted into the receptacle means.

23. A shoe according to claim 22, wherein the receptacle means includes means for locking the removable spring cartridge in an inserted position in the receptacle means.

24. A shoe according to claim 23, further including means, disposed on a surface of the athletic shoe and operable by the wearer, for releasing the removable spring cartridge from the means for locking.

25. A shoe according to claim 24, further including ejection means, disposed on at least one of the removable spring cartridge and the receptacle means, for ejecting the removable spring cartridge from the receptacle means upon operation of the means for releasing.

26. A method for providing wearer selectable shock energy absorption in a shoe having an upper and a sole, the method comprising the steps of:

providing, in the sole, absorbing means, removable by a wearer of the shoe, for absorbing shock energy and returning at least a portion of the absorbed shock energy to the foot of the wearer, the absorbing means including a removable spring cartridge including a spring plate having a spring member upwardly inclined and cantilevered relative to a plane of the spring plate, and a first pair of lateral side rails; and disposing, in the sole, receptacle means for supporting the absorbing means in the shoe.

* * * * *